US006217464B1

(12) United States Patent
Chang

(10) Patent No.: US 6,217,464 B1
(45) **Date of Patent: *Apr. 17, 2001**

(54) GOLF BALL WITH REDUCED SPIN

(76) Inventor: Dale U. Chang, 2900 Sun Bittern Ct., Windermere, FL (US) 34786

( * ) Notice: Subject to any disclaimer, the term of this patent is extended or adjusted under 35 U.S.C. 154(b) by 0 days.

This patent is subject to a terminal disclaimer.

(21) Appl. No.: 09/152,301

(22) Filed: Sep. 14, 1998

Related U.S. Application Data

(63) Continuation-in-part of application No. 08/845,444, filed on Apr. 25, 1997, now Pat. No. 5,827,133.

(51) Int. Cl.[7] ..... A63B 37/12

(52) U.S. Cl. ..... 473/378; 473/371; 473/374; 473/351

(58) Field of Search ..... 473/330, 370, 473/594, 124, 376, 195, 237, 378, 377

(56) References Cited

U.S. PATENT DOCUMENTS

| | | | | |
|---|---|---|---|---|
| 790,252 | | 5/1905 | Mahaut . | |
| 2,542,356 | * | 2/1951 | Radford | 473/376 |
| 3,517,933 | | 6/1970 | Malkin . | |
| 4,598,909 | * | 7/1986 | Ventura et al. | 473/594 |
| 5,026,054 | | 6/1991 | Osher et al. . | |
| 5,037,104 | * | 8/1991 | Watanabe et al. | 473/354 |
| 5,120,358 | * | 6/1992 | Pippett | 473/237 |
| 5,150,906 | | 9/1992 | Molitor et al. . | |
| 5,314,187 | * | 5/1994 | Proudfit | 473/374 |
| 5,425,989 | * | 6/1995 | Ogawa et al. | 428/333 |
| 5,603,664 | * | 2/1997 | Provost | 473/168 |
| 5,703,166 | * | 12/1997 | Rajagopalan et al. | 473/372 |
| 5,718,655 | * | 2/1998 | Phillips | 482/49 |
| 5,743,812 | * | 4/1998 | Card | 473/327 |
| 5,827,133 | * | 10/1998 | Chang | 473/370 |
| 5,836,827 | * | 11/1998 | Ogawa et al. | 428/333 |
| 5,885,171 | * | 3/1999 | Sharpe | 473/330 |
| 5,891,000 | * | 4/1999 | Phillips | 482/49 |

* cited by examiner

*Primary Examiner*—Stephen F. Gerrity
*Assistant Examiner*—Mitra Aryanpour
(74) *Attorney, Agent, or Firm*—James H. Beusse; David G. Maire; Holland & Knight LLP

(57) ABSTRACT

A golf ball having a lubricating material on its surface for reducing the spin imparted by a striking golf club. The lubricating material may be a dry lubricant coating or it may be a lubricating material forming part of the cover of the golf ball.

10 Claims, 2 Drawing Sheets

GOLF BALL WITH REDUCED SPIN

SPECIFIC DATA RELATED TO APPLICANT

This application is a continuation-in-part of patent application Ser. No. 08/845,444 filed Apr. 25, 1997, now U.S. Pat. No. 5,827,133 issued on Oct. 27, 1998.

The present invention relates to golf balls and, more particularly, to a golf ball having a low spin rate.

BACKGROUND OF THE INVENTION

The majority of commercially available golf balls are advertised as having high spin rates since such spin rates are desirable for the better golfer. A high spin rate in a golf ball indicates that the ball rotates very rapidly about its axis when struck by the skilled player. The advantage of the high spin rate is that the ball can be made to produce a reverse or back spin so that the ball stops very quickly when hit into a green on an approach shot.

While high spin rates are desirable for the professional or better golfer, most amateur golfers are not capable of hitting a ball in a manner to produce controlled spin on the ball. More importantly, most amateur golfers have a swing which is either an inside-out or outside-in swing that produces side spin on the ball. Side spin causes the ball to move laterally off a desired target line, i.e., in either a hook or slice direction. For such amateur golfers, a better golf ball would be a ball with a reduced or even zero spin rate so that the ball travels in essentially a straight line from the club face without the detrimental side spin. A ball which eliminates most of the spin will travel a further distance in a desired direction.

U.S. Pat. No. 5,368,304 describes a low spin golf ball in which the spin rate is reduced by using the combination of a soft core and a hard outer cover. In addition, that patent suggests that spin rate can be further reduced by decreasing the weight of a softened polybutadiene core while maintaining core size and by increasing the thickness of the cover. The golf ball in the '304 patent may also be made larger than the standard 1.680 inch golf ball to provide a further reduced spin rate. While these designs are successful in reducing the spin rate of golf balls, many golfers object to a golf ball which has a very hard feel such as occurs when using a very hard cover on a golf ball. When struck with an iron club, such golf balls tend to induce vibrations into the club which are undesirable even to the unskilled golfer. Furthermore, while the use of a ball which is slightly oversized, such as, for example, the Top Flite Magna™ sold by Spalding & Evenflo Companies, Inc., many golfers are opposed to using an oversized ball and would prefer to have a ball which is the same size as those played by professional golfers. Accordingly, it would be desirable to provide a ball which has the same general feel and size characteristics of the ball used by professional golfers while at the same time having the advantage of a very low or zero spin rate to compensate for side spin often induced by the amateur golfer.

SUMMARY OF THE INVENTION

A golf ball in accordance with the present invention for reducing spin rate is manufactured with a thin layer of a dry lubricant on the outer surface of the outer cover of the ball. The lubricant is preferably a fluoropolymer or similar low friction materials. The golf ball may be constructed with an inner solid core formed of a polybutadiene elastomeric material and an outer cover formed of a thermal plastic resin such as ionomer resin to create a conventional two-piece golf ball. The lubricant may be sprayed or vacuum deposited on the outer cover or the ball may be dipped into fluoropolymer solution and then dried. The thickness of the lubricant coating may be in the range from $1\times10^{-6}$ to 10.0 mils (thousandths of an inch). When a ball constructed in accordance with this arrangement is struck by a club, the ball will tend to slip or slide with respect to the club face so that the spin normally imparted to the ball by striking with a club is substantially reduced.

A further reduction in spin can be achieved by establishing a layer of lubricant between the core and cover of a golf ball so as to allow the cover to "slip" with respect to the core. The use of a lubricant between the outer cover and inner core may be extended to golf balls in which there is an inner cover interposed between the core and the outer cover such as, for example, in the Top Flite™ golf balls sold under the tradename Strata™. This double cover arrangement in a golf ball provides for a further opportunity to isolate the outer cover from the inner core using a lubricant interface. In particular, the inner core can be covered by a lubricant prior to compression molding the inner cover over the core and then a second layer of lubricant can be placed over the inner cover prior to molding the outer cover over the ball. In this respect, there is now two lubricant layers which provides for greater opportunity for the outer cover to rotate with respect to the inner core in response to being struck by a golf club. Moreover, any spin imparted to the outer cover will be quickly absorbed by the inner cover and inner core to either stop or reduce the overall spin rate of the golf ball and minimize any tendency of the ball to have a spin rate which would cause the ball to fly off line. It will be recognized that the invention may also be applied to conventional three-piece balls, i.e., balls which have an inner wound core and an outer cover of either a natural or synthetic polymeric composition.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
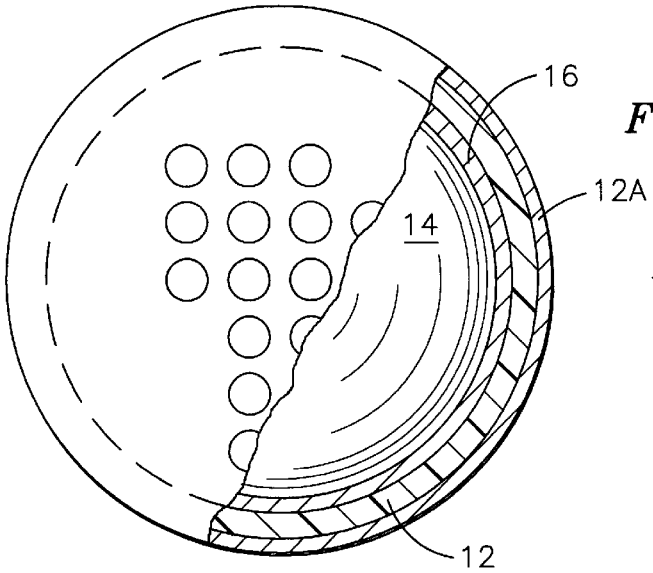
FIG. 1 is a partial cross-sectional view of a golf ball showing one application of the present invention.

The present invention relates to a golf ball and method of manufacturing a golf ball which complies with the United States Golf Association (USGA) regulations and minimizes the tendency of a golf ball to hook or slice when struck by a golf club. FIG. 1 illustrates in partial cross-sectional view the structure of a conventional two-piece golf ball 10 incorporating at least some of the teaching of the present invention. In particular, the golf ball illustrated in FIG. 1 includes an outer elastomeric cover 12 typically formed of an ionomer resin such as that sold by E.I. Dupont de Nemours Company under the trademark "Surlyn". The cover 12 overlays an inner core which is typically molded from an elastomeric composition such as polybutadiene with various additives. A more comprehensive discussion of various compositions which may be used to form the core 14 and the outer cover 12 is given in U.S. Pat. No. 5,368,304. The particular compositions of which the core 14 and cover 12 are produced is not considered a part of the invention. In a first embodiment of the present invention, the outer cover 12 is coated by a relatively thin layer of a lubricating material 12A. The lubricating layer 16 has a thickness in the range of $1\times10^{-6}$ to 10.0 mils and preferably between 0.01 to 1.0 mils. The lubricating film or layer 12A provides a low coefficient of friction between the outer cover and a golf club striking the ball 10 to reduce transmission of any friction force to the ball from the club.

When the golf ball of FIG. 1 is struck by a golf club in such a manner as to attempt to induce rotation or spin of the ball about an axis passing through the center of the ball, the outer cover 12 will momentarily slip on the club face due to the low coefficient of friction induced by the lubricating layer 12A. The actual time during which the club face is in contact with the ball can be measured in milliseconds so that the time during which the cover is experiencing an accelerating force is relatively short and the corresponding slippage of the club face against the ball is relatively small such that there is not believed to be any appreciable loss of acceleration transfer to the ball from the slippage.

In a second embodiment of the present invention, the outer cover 12 is separated from the inner core 14 by a relatively thin layer of a lubricating material 16 in addition to use of an outer coating 12A.

However, the outer coating 12A does not have to be present. The lubricating layer 16 forms a boundary layer between the cover and core having a thickness in the range of $1\times10^{-6}$ to 10.0 mils and preferably between 0.01 to 1.0 mils. The boundary layer 16 allows the opposing surfaces of the cover and core to partially ride on a lubricating film and to partially rub together as surface high points come in contact. The lubricating film provides a low coefficient of friction between the mating surfaces of the core and outer cover to reduce transmission of any friction force to the core from the cover.

When the golf ball of this second embodiment is struck by a golf club in such a manner as to attempt to induce rotation or spin of the ball about an axis passing through the center of the ball, any rotation which might be imparted to ball 10 by the club will be compensated for by the outer cover 12 momentarily slipping about the core 14 due to the low coefficient of friction induced by the lubricating layer 16. As mentioned above, the actual time during which the club face is in contact with the ball can be measured in milliseconds so that the time during which the cover is experiencing an accelerating force is relatively short. As soon as the club face loses contact with the ball, the inertia of the core 14 causes any spin induced in the cover to rapidly drop to the spin velocity of the core. Core spin velocity may be approximately zero.

The low friction materials include dry lubricants such as fluoropolymers (Teflon, PTFE, FEP, FFA, PFPE, PFA, PPS, PVDF, TFE, etc.), MoS2, graphite, and similar materials that are known as dry lubricants or release agents.

Examples of commercial products are Dupont's Teflon series dry lubricants, and Krytox series of release agents/dry lubricants such as MS-122DF, MS-134DF, MS-322, MS-143N, MS-143N-Blue, MS-143N-30, MS-143N-10, MS-143N-5, MS-143N-2.5, MS-143N-1.0, MS-122N/CO2, MS-122A-Red, etc.

Similar dry lubricant products are manufactured by Whitford Corporation, EM Corporation, Ausimont USA, Inc., and Elf Atochem North America, Inc. under the brand name of Xylan, Kynar, Halar, Tefzel and others.

Other examples of dry lubricants are a release agent MS-122N/CO2 (aerosol can) and MS143N (5-gallon drum), a Teflon-like TFE release agent distributed by Miller-Stephenson Chemical Company, Inc.

Other examples of dry lubricant coatings are: TLF-9115, Krytox DF/50, TLF-9015, TLF-9044H, Krytox-1000, and Krytox-DF, all proceded by DuPont Chemical Company.

Similar dry lubricant coatings can be done using a commercial coating process and a coating sold under the brand name of CSI-1000, CSIIon-1000, and CSIIon-2000 by Coating Systems, Inc.

The application methods can be any techniques for coating of a golf ball surface such as spray, dip, wipe, brush, electrostatic coating, fluidized bed, tumbling, powder/grit blasting, vacuum deposition, etc. The golf balls may be mixed with dry lubricant powders in a vibratory container for the dry lubricants to adhere onto the golf ball surface. Golf balls are mixed with dry lubricants in a tumbler for coating of the dry lubricant and for adherence onto the cover. Any mechanical motion of rubbing and pressing for coating of dry lubricants are acceptable methods.

The dry lubricants may be dispersed and suspended in a fluid solvent for other applications such as spraying and dipping. This kind of dry lubricant carrier may be any liquid form to coat the dry lubricants evenly. One example of such solvent is HCFC 141b whose composition is CH3CCL2F. The boiling point of this solvent is 32 degrees C and its density is 1.23 grams/cc at 25 degrees C. PTFE particles of 6 micron size (range is 1 to 20 microns) is mixed with this solvent for application to the golf balls. The typical concentration of the PTFE (density is 2.2 grams/cc) is in the range of 1 to 15%. Before application, the golf ball surface should be clean and dry. The mixture solution should be agitated before use as the PTFE will settle during storage.

Fine particles of dry lubricants may be mixed with golf ball coating materials such as urethane resin for coating. Urethane resin is commonly used for protective coating of golf balls.

Another technique of coating is to wrap the golf ball with a thin film of fluoropolymer for thermoform or compression mold to have a thin jacket of dry lubricant coating. In this process, the golf ball may be coated with fine powder of dry lubricants instead of wrapping with a thin film.

Other similar processes of coating that are known to persons familiar with the art of coating may also be used.

The cover materials (such as Surlyn ionomer) may be mixed with dry lubricants to provide lubricity of the golf ball against the club face. Sometimes, the coating may be cured at an elevated temperature for a better performance of the coating. The baking temperature should not be too high to prevent the golf ball from melting. Some low temperature fluoropolymers may be baked at 350 degrees F. The dry lubricant coating may be subject to an instantaneous intense heat such as laser or hot iron for surface melting.

Dry lubricants may be coated on the golf ball after the golf ball is processed for a better adhesion of dry lubricant coating on the golf ball surface. The pre-coating process includes cleaning and washing the balls with water and detergent or cleaning solvents. The coating can be applied at this stage or the balls may be prepared further for bonding using a corona/plasma discharge treatment, buffing, tumbling with fine powders, fine powder air blasting (similar to sand blasting), and vibratory tumbling. Sometimes, an intermediary coating can be applied before the dry lubricant coating. The intermediary coating includes similar coating techniques as listed earlier or other types of suitable undercoatings such as metallic coatings. The coating material is applied over the undercoat using the method of application described above.

Figure 2:
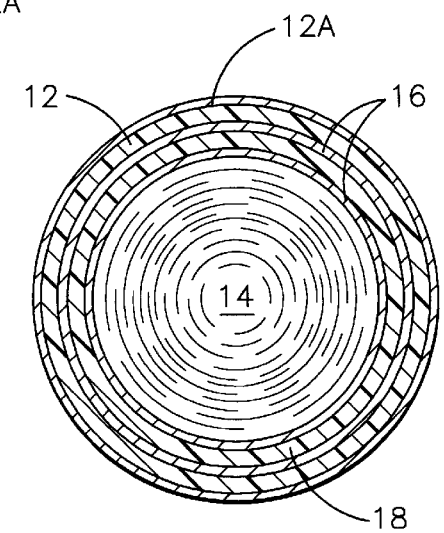
FIG. 2 is a schematic representation of a golf ball with which the present invention may be used.

FIG. 2 is a schematic representation of a two-piece golf ball having a double outer cover, such as that found in the Top Flite Strata™ golf ball. In this embodiment, the inner core 14 is first enclosed in an inner cover 18 and then an outer cover 12 is compression or injection molded over the inner cover. In order to create a slipping or sliding interface between the outer cover 12 and inner core 14, it may be desirable to incorporate a first lubricating interface between the core and inner cover 18 and a second lubricating interface between the inner cover 18 and outer cover 12. As with the golf ball of FIG. 1, the inner core is typically formed of a elastomeric composition which is compression molded into the approximate shape of the golf ball. The resultant inner core 14 may then be either dipped or sprayed with a lubricating film prior to inserting into a compression mold in which the inner cover 18 is compression molded to the core. The outer surface of the inner core then is covered with a lubricating film by, for example, dipping the ball into a liquid or fluid bed or spraying the inner cover with a lubricating film or by other means known in the art. The film covered ball is then placed into a final compression molding operation in which the outer cover 12 is compressly molded or injection molded to the ball. The conventional dimples are normally formed in the outer cover during this final molding step. Thereafter, the finished ball may be sprayed with or dipped into a lubricating fluid which, when dry, is virtually invisible yet provides an outer slippery surface.

While ease of manufacturing may dictate that the lubricating film be placed on the ball during the manufacturing process by dipping the ball into a lubricating material, it may be desirable in some applications to form the ball with a relatively thin layer of a lubricating material such as PTFE (Teflon®). Use of a solid material for the lubricating film may be desirable in the case where the inner core 14 is a wound core such as commonly found in golf balls manufactured by the Acushnet Company under the trademarks Titleist Tour or Titleist DT. It may even be practical to coat the dry lubricant layer with another layer of a lubricating material such as a petroleum lubricant or a synthetic lubricant.

The following materials are exemplary of the types of materials that may be used to form a lubricating film between the outer cover 12 and inner core 14 or inner cover 18:

1. Petroleum based lubricants such as oil and grease.
2. Synthetic lubricants in the form of oil and grease such as polyglycols, phosphate esters, chlorofluorolubricants, polyphenyl esters, silicones, dibasic acid esters (or diesters), esters, polyethers, polyaromatics, silicate esters, and highly fluorinated compounds.
3. Solid lubricants including MoS2 (molybdenum disulfide), PTFE (polytetrafluoroethylene), and graphite.

The preferred lubricating material for coating the outside surface of ball 10 is a dry material such as the above mentioned fluoropolymers which will give the outer surface a slippery characteristic so that when struck by a golf ball, the cover will tend to slide on the club face rather than to stick to the club face and thereby reduce the spin imparted to the ball by the club face. Typical examples of fluoropolymers are polytetrafluoroethylene (PTFE), tetrafluorethylene (TFE) and perfluoropolyether (PFPE), PTFE being more commonly known under the trademark Teflon. Other dry lubricants such as molydenum disulfide ($M_OS_2$) or graphite could be used but are undesirable because of their black coloring.

Fluoropolymers are convenient materials for establishing a lubricating film on the outer surface of a golf ball since these materials can be suspended in a solvent for uniform application, either by brushing, spraying or dipping. Further, some fluoropolymers are commercially available in solvent solution. For example, Miller-Stephenson Chemical Company, Inc. distributes a line of products generally used for die release agents but which is essentially PFPE solution. One particular product is designated Krytox MS-122DF and is a milky colored fluid which contains 77–80% of 1,1, dichloro-1-fluoroethane, 1% of Telomer of TFE and 18–20% of 1,1,1,2-tetrafluoroethane. This product can be sprayed as an aerosol or the golf balls can be dipped into the fluid. Applicant has found that concentrations of PTFE dry lubricant may range from 1% to 15% in solution but that a concentration of about 3% provides a desirable slippery characteristic to the golf ball cover.

In addition to the above material, the same company also distributes an aerosol spray of a TFE solution under the designation MS-122N/CO2 and a non-aerosol TFE solution under the designation MS-143N. Numerous other fluoropolymers are produced and distributed by E.I. Dupont de Neumers, Inc. Suitable coatings from Dupont are marketed under the tradenames Teflon PTFE, Teflon FEP, Teflon-S, Teflon Dry Lubricant and Teflon-P PFA. When applied to a golf ball, these coatings can produce a coefficient of friction in the range from 0.05 to 0.20. It should be noted that some of these coatings may require elevated temperature curing.

In applying these coatings to a golf ball, it is desirable to prepare the ball surface by cleaning and grit blasting for optimum adhesion of the coating. The Teflon coatings are generally applied with electrostatic or conventional compressed air paint spraying equipment. Some of the products can be applied by airless spray, coil coating, fluidized bed or a dipped process. Many Teflon finishes are single coat systems but some employ a primer, either air dried or baked, followed by one or more top coats. To obtain optimum film properties, PTFE products are sometimes baked at a minimum of 725° F., PFA products are baked at 600° F. and FEP products are baked at 575° F. Teflon-S products have variable baking requirements, some of which are as low as 325° F.

Figure 3:
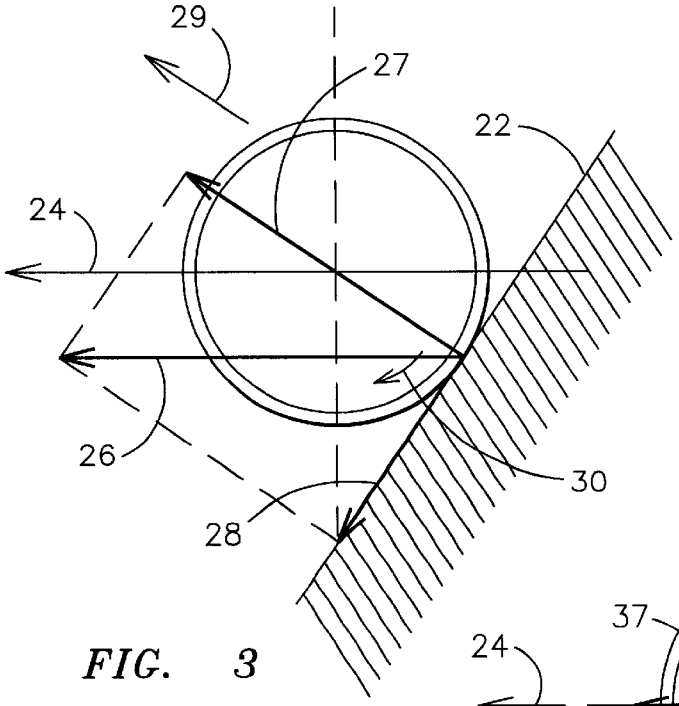
FIG. 3 illustrates the effect of an angled club face striking a golf ball.
Figure 4:
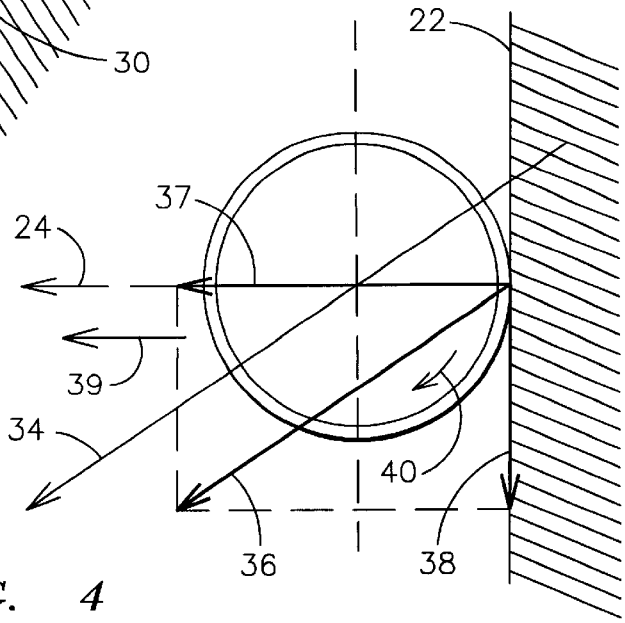
FIG. 4 illustrates the effect of a club face striking a ball when the face is square to a target line and the path of club travel is off line.

In order to understand the mechanism by which the present invention overcomes the tendency of a golf ball to spin and thus impart sideways motion to the golf ball, reference is now made to FIGS. 3 and 4 which illustrate the various forces imposed on a golf ball by a club face striking a ball with either the club face in an open position with respect to desired line of flight of the ball or with the club face square to the desired target line but with the direction of impact being at an angle to the desired target line. Turning first to FIG. 3, the club face 22 is shown in an open position with respect to the desired target line 24. As a result, the club face initially contacts the ball at a point inside (with respect to the golfer's position) the target line 24 which extends through the center of the ball causing the hitting force 26 to divide into normal force component 27 and tangential force component 28. The normal force 27 is used to carry the ball in the ball flight direction 29 while the tangential force 28 generates a moment about the center of the ball causing the ball to rotate as indicated by the arrow 30. The tangential force 28 is reduced if the coefficient of friction between the club face 22 and the ball is low. This low tangential force will generate low moment thus causing less spin to the ball for less slice. The spin imparted to the golf ball, in this example, a counterclockwise spin, causes the ball to have a slicing path of travel, i.e., to move in a clockwise direction.

A similar result occurs if the club face is actually square to the target line 24 but approaches the target line at an angle such as that indicated at 34 of FIG. 4. In this example, the club face initially contacts the ball at a point on the target line 24 extending through the center of the ball but the direction of travel of the club creates a hitting force 36 which divides into normal force component 37 and tangential force component 38. The normal force 37 is used to carry the ball in the ball flight direction 39 while the tangential force 38 generates a moment about the center of the ball causing the ball to rotate as indicated by the arrow 40. As a result, the ball leaves the club face in the general direction 39 of the target line but then deviates into a slice or clockwise motion away from the target line.

In both the actions illustrated in FIG. 3 and in FIG. 4, if the frictional force (tangential forces 28 and 38) between the club face and the ball can be reduced so that the ball is not imparted with a spinning motion by its impact with a club, then the ball will have more of a tendency to travel in a straight line as it leaves a club. Such reduction in frictional force can be achieved by making the outer cover "slippery" as described above. Although the ball flight in FIG. 3 is not likely to be in the desired direction, i.e., along the target line, it will at least fly in a straight direction rather than veering substantially off of the initial ball flight path due to the spin on the ball. In the situation illustrated in FIG. 4, the ball will actually move along the target line even though the path of the club face is not along the target line. By eliminating the spin imparted to the ball by the club face, the path can be straight even though the club face is not moving in that target line direction. The outer cover is designed to slip against the club face and minimize the transfer of the frictional (tangential) force which creates spin on the ball.

The slipperiness of the golf ball not only reduces the tendency of slice or hook, but it also reduces the back spin caused by the loft angle of the club.

Figure 5:
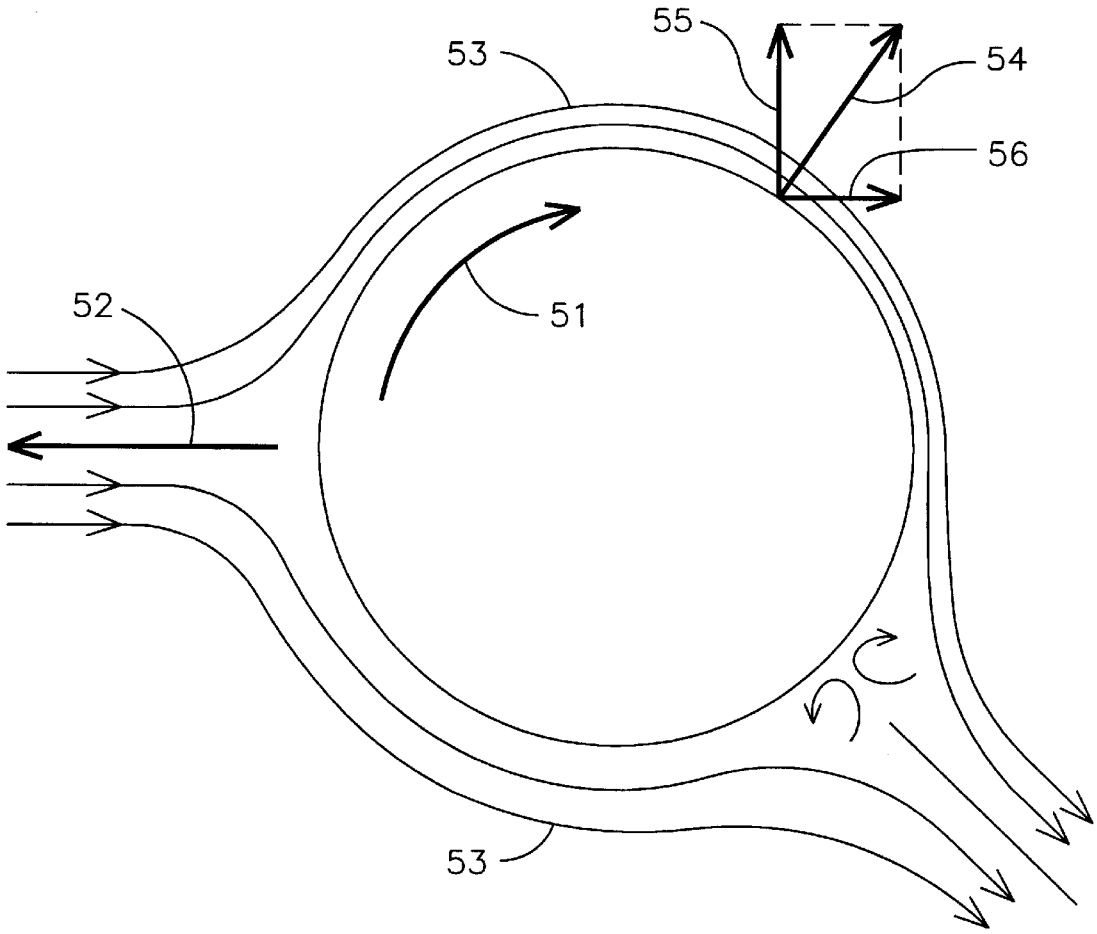
FIG. 5 is an air flow diagram showing the effect of reduced spin in extending the flight distance of a golf ball.

The reduction or elimination of the back and side spin increases the flight and roll distance of the ball. Reduction of side spins also increases the travel distance of the golf ball. The spinning of the ball induces a drag component to the ball as shown in FIG. 5. When a golf ball spins in the direction of 51 as it travels in the direction of 52, air streams 53 form around the ball as in the case with an airplane wing. The imbalance of the streams causes pressure difference and a resulting force 54. This force may be divided into the vertical component 55 and the horizontal component 56 as shown in FIG. 5. The force 55 causes a slice (in the case of side spin) or a lift (in the case of back spin) of the golf ball. The force 56 acts as a drag and reduces the ball flight distance. In the case of a back spin, the roll distance is also reduced. The pressure difference effect may be reduced by having dimples on the golf ball. This invention of reduced spin golf ball is for elimination of slice and hook as well as to increase the ball travel distance by reducing or eliminating the ball spinning which causes the unwanted force 54.

The techniques described in this invention can be used singularly, collectively or in any combination. The desired degree of spin reduction and the ease of manufacturing may determine the particular technique selected for implementation.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A golf ball comprising:

an inner core;

an outer cover encompassing said core; and a dry lubricant film on said outer cover such that said ball slips when struck by a face of a golf club when the face orientation is not normal to a direction of travel of the golf club at the point of impact;

wherein said lubricant layer is selected from the group comprising:

petroleum based lubricants such as oil and grease; synthetic lubricants including oil and grease of polyglycols, phosphate esters, chlorofluorolubricants, polyphenyl esters, silicones, dibasic acid esters (or diesters), esters, polyethers, polyaromatics, silicate esters, and highly fluorinated compounds; solid lubricants including MoS2 (molybdenum disulfide), PTFE (polytetrafluoroethylene), graphite and silicone fluid.

2. A golf ball comprising:

an inner core;

an outer cover encompassing said core; and a dry lubricant film on said outer cover such that said ball slips when struck by a face of a golf club when the face orientation is not normal to a direction of travel of the golf club at the point of impact;

wherein said dry lubricant film comprises a fluoropolymer;

wherein said dry lubricant film comprises between about 15–20% by weight of PTFE and 1–5% by weight silicone fluid.

3. A golf ball comprising:

an inner core;

an outer cover encompassing said core; and a dry lubricant film on said outer cover such that said ball slips when struck by a face of a golf club when the face orientation is not normal to a direction of travel of the golf club at the point of impact;

and including an inner cover between said core and said outer cover;

and including a lubricating film between said inner cover and said outer cover;

and including a lubricant layer between said inner cover and said core.

4. A golf ball comprising:

an inner core;

an outer cover encompassing said core; and a dry lubricant film on said outer cover such that said ball slips when struck by a face of a golf club when the face orientation is not normal to a direction of travel of the golf club at the point of impact;

wherein said dry lubricant film comprises a flurorpolymer; and wherein said fluoropolymer is selected from the group of PTFE, FEP, FFA, PFPE, PFA, PPS, PVDF, and TFE.

5. A golf ball having an outer surface, wherein the improvement comprises a layer of lubricating material disposed on the outer surface, wherein the lubricating material comprises MoS2 and graphite.

6. A golf ball having an outer surface, wherein the improvement comprises a layer of lubricating material disposed on the outer surface, wherein the lubricating material comprises a mixture of a dry lubricant and a resin.

7. A golf ball having an outer surface, wherein the improvement comprises a layer of lubricating material disposed on the outer surface, wherein the lubricating material has a coefficient of friction of 0.05–0.20.

8. A golf ball comprising:

an inner core;

an outer cover encompassing the inner core and having an outer surface; and a layer of lubricating material disposed on the outer surface, wherein the lubricating material comprises MoS2 and graphite.

9. A golf ball comprising:

an inner core;

an outer cover encompassing the inner core and having an outer surface; and a layer of lubricating material disposed on the outer surface, wherein the lubricating material comprises a mixture of a dry lubricant and a resin.

10. A golf ball comprising:

an inner core;

an outer cover encompassing the inner core and having an outer surface; and a layer of lubricating material disposed on the outer surface, wherein the lubricating material has a coefficient of friction of 0.05–0.20.

* * * * *